US010844542B2

(12) United States Patent
Hietaniemi et al.

(10) Patent No.: US 10,844,542 B2
(45) Date of Patent: Nov. 24, 2020

(54) METHOD FOR PROVIDING A PRETREATED FILLER COMPOSITION AND ITS USE IN PAPER AND BOARD MANUFACTURING

(71) Applicants: Kemira OYJ, Helsinki (FI); UPM-Kymmene Corporation, Helsinki (FI); Stora Enso OYJ, Helsinki (FI)

(72) Inventors: Matti Hietaniemi, Helsinki (FI); Mikko Virtanen, Helsinki (FI); Katariina Torvinen, Vtt (FI); Terhi Saari, Vtt (FI); Erkki Hellen, Vtt (FI)

(73) Assignees: KEMIRA OYJ, Helsinki (FI); UPM-KYMMENE CORPORATION, Helsinki (FI); STORA ENSO OYJ, Helsinki (FI)

( * ) Notice: Subject to any disclaimer, the term of this patent is extended or adjusted under 35 U.S.C. 154(b) by 0 days.

(21) Appl. No.: 15/108,670

(22) PCT Filed: Dec. 17, 2014

(86) PCT No.: PCT/EP2014/078225
§ 371 (c)(1),
(2) Date: Jun. 28, 2016

(87) PCT Pub. No.: WO2015/101498
PCT Pub. Date: Jul. 9, 2015

(65) Prior Publication Data

US 2016/0319487 A1 Nov. 3, 2016

(30) Foreign Application Priority Data

Dec. 30, 2013 (SE) ..... 1351588

(51) Int. Cl.

| | |
|---|---|
| ***D21H 17/67*** | (2006.01) |
| ***D21H 11/18*** | (2006.01) |
| ***D21H 21/18*** | (2006.01) |
| ***D21H 17/69*** | (2006.01) |
| ***D21H 17/34*** | (2006.01) |
| ***D21H 17/37*** | (2006.01) |

(52) U.S. Cl.
CPC ..... *D21H 17/675* (2013.01); *D21H 11/18* (2013.01); *D21H 17/34* (2013.01); *D21H 17/375* (2013.01); *D21H 17/69* (2013.01); *D21H 21/18* (2013.01)

(58) Field of Classification Search
CPC ..... D21H 11/18; D21H 17/375; D21H 17/69; D21H 21/10; D21H 17/67; D21H 21/18; D21H 17/675; D21H 17/45; D21H 17/42; D21H 17/44; Y10S 977/963
See application file for complete search history.

(56) References Cited

U.S. PATENT DOCUMENTS

| | | | | |
|---|---|---|---|---|
| 5,695,609 | A * | 12/1997 | Petander | D21H 17/375 162/164.1 |
| 7,883,603 | B2 * | 2/2011 | Hund | D21H 21/18 162/164.1 |
| 8,784,611 | B2 * | 7/2014 | Juppo | D21H 21/10 162/157.6 |
| 8,945,345 | B2 * | 2/2015 | Laine | D21H 11/18 162/175 |
| 8,992,732 | B2 * | 3/2015 | Lindstrom | D21H 17/375 162/164.6 |
| 9,080,288 | B2 * | 7/2015 | Hietaniemi | C09C 1/42 |
| 9,157,189 | B2 * | 10/2015 | Heiskanen | D21H 11/18 |
| 9,181,653 | B2 * | 11/2015 | Paltakari | D21H 11/18 |
| 9,458,571 | B2 * | 10/2016 | Laine | D21H 11/18 |
| 9,506,197 | B2 * | 11/2016 | Laine | D21H 11/18 |
| 9,506,198 | B2 * | 11/2016 | Laine | D21H 11/18 |
| 9,518,364 | B2 * | 12/2016 | Heiskanen | D21H 11/18 |
| 9,605,382 | B2 * | 3/2017 | Virtanen | D21H 17/63 |
| 9,702,085 | B2 * | 7/2017 | Kosonen | D21H 11/18 |

(Continued)

FOREIGN PATENT DOCUMENTS

| | | | |
|---|---|---|---|
| CA | 2934998 A1 * | 7/2015 | C09C 1/021 |
| EP | 2 319 984 A1 | 5/2011 | |

(Continued)

OTHER PUBLICATIONS

Svedberg, Anna in "Valuation of retention/formation relationships using a laboratory pilot-paper machine," 2007, Royal Institute of Technology, pp. 1-41. (Year: 2007).*

(Continued)

*Primary Examiner* — Jose A Fortuna

(74) *Attorney, Agent, or Firm* — Nath, Goldberg & Meyer; Tanya E. Harkin; Joshua B. Goldberg

(57) ABSTRACT

The present invention relates to a method for providing a pretreated filler composition for use in paper and board manufacturing including the steps of: a) providing a filler comprising precipitated calcium carbonate, said filler being in the form of a slurry comprising no additives; b) providing at least one polymer selected from polyvinylamine or polyacrylic amide, said polymer having a charge density of an absolute value of at most 4 meq/g determined at pH 7; c) combining said at least one polymer of step b) with the filler of step a); d) providing a slurry of nanofibrillar cellulose; e) combining said nanofibrillar cellulose slurry with the formed combination of step c) and forming a pretreated filler composition comprising aggregates. Further it also relates to a pretreated filler composition prepared therefrom, and its use in stocks, paper and paper board.

25 Claims, No Drawings

(56) References Cited

U.S. PATENT DOCUMENTS

| | | | | |
|---|---|---|---|---|
| 9,752,284 | B2 * | 9/2017 | Hietaniemi | D21H 17/375 |
| 9,777,143 | B2 * | 10/2017 | Sumnicht | D21H 17/675 |
| 9,809,930 | B2 * | 11/2017 | Karppi | D21H 17/375 |
| 9,828,727 | B2 * | 11/2017 | Kosonen | D21H 11/18 |
| 9,873,982 | B2 * | 1/2018 | Harrington | D21H 17/25 |
| 9,982,394 | B2 * | 5/2018 | Hokka | D21H 17/36 |
| 10,030,335 | B2 * | 7/2018 | Hietaniemi | C08L 33/26 |
| 10,053,817 | B2 * | 8/2018 | Gane | D21C 9/007 |
| 10,106,928 | B2 * | 10/2018 | Husband | D21H 17/74 |
| 10,301,186 | B2 * | 5/2019 | Fukuoka | D21H 19/385 |
| 2009/0267258 | A1 | 10/2009 | Cheng | |
| 2012/0080156 | A1 | 4/2012 | Laleg et al. | |
| 2012/0132383 | A1 * | 5/2012 | Laine | D21H 11/18 162/175 |
| 2012/0205065 | A1 | 8/2012 | Esser | |
| 2012/0227920 | A1 * | 9/2012 | Juppo | D21H 21/10 162/164.6 |
| 2013/0017394 | A1 * | 1/2013 | Hua | D21D 1/20 428/401 |
| 2014/0216673 | A1 * | 8/2014 | F. Chin | D21H 17/25 162/177 |
| 2014/0345816 | A1 * | 11/2014 | Heiskanen | D21H 11/18 162/158 |
| 2014/0345817 | A1 * | 11/2014 | Lindstrom | D21H 17/375 162/164.6 |
| 2014/0360691 | A1 * | 12/2014 | Hietaniemi | C09C 1/42 162/168.3 |
| 2015/0101769 | A1 * | 4/2015 | Laine | D21H 11/18 162/9 |
| 2015/0101770 | A1 * | 4/2015 | Laine | D21H 11/18 162/9 |
| 2015/0144279 | A1 * | 5/2015 | Laine | D21H 11/18 162/9 |
| 2016/0032530 | A1 * | 2/2016 | Virtanen | D21H 11/18 162/164.6 |
| 2016/0053437 | A1 * | 2/2016 | Husband | D21B 17/63 162/9 |
| 2016/0201265 | A1 * | 7/2016 | Kosonen | D21H 11/18 162/175 |
| 2016/0230341 | A1 * | 8/2016 | Husband | D21H 17/25 |
| 2016/0273165 | A1 * | 9/2016 | Laine | D21H 11/20 |
| 2016/0319485 | A1 * | 11/2016 | Hietaniemi | C09C 1/021 |
| 2016/0319487 | A1 * | 11/2016 | Hietaniemi | D21H 11/18 |
| 2017/0027168 | A1 * | 2/2017 | Heath | A01N 25/30 |
| 2017/0101740 | A1 * | 4/2017 | Harrington | D21H 17/25 |
| 2017/0284026 | A1 * | 10/2017 | Skuse | D21H 13/40 |
| 2017/0306562 | A1 * | 10/2017 | Phipps | D01D 5/08 |
| 2019/0048529 | A1 * | 2/2019 | Hietaniemi | D21H 17/375 |
| 2019/0242065 | A1 * | 8/2019 | Hietaniemi | D21H 17/29 |
| 2019/0309476 | A1 * | 10/2019 | Karisalmi | D21H 11/12 |

FOREIGN PATENT DOCUMENTS

| | | | | |
|---|---|---|---|---|
| EP | 3090099 | B1 * | 2/2018 | |
| JP | 2006-118092 | A | 5/2006 | |
| WO | 2009036271 | A1 | 3/2009 | |
| WO | 2009/153225 | A1 | 12/2009 | |
| WO | 2010125247 | A2 | 11/2010 | |
| WO | 2013/107933 | A1 | 7/2013 | |
| WO | 2013107933 | A1 | 7/2013 | |
| WO | WO-2015101498 | A1 * | 7/2015 | D21H 11/18 |
| WO | WO-2015101499 | A1 * | 7/2015 | C02C 1/021 |

OTHER PUBLICATIONS

Liimatainen et al. in "Retention of PCC and GCC fillers on chemical pulp fines surfaces," Sep. 2008, TAPPI Journal, pp. 38-42. (Year: 2009).*

Antunes et al., in "Use of New Branched Cationic Polyacrylamides to Improve Retention and Drainage in Papermaking," 2008, 47 pp. 9370-9375. (Year: 2008).*

Machine Translation of JP-2006118093 (Year: 2006).*

Office Action dated Jun. 30, 2014 issued in corresponding Swedish Application No. 1351588-7.

International Search Report dated Feb. 2, 2015 issued in corresponding International Application No. PCT/EP2014/078225.

Communication of Further Notices of Opposition dated Dec. 3, 2018 corresponding to European Application No. 14815687.0-1102.

Communication of Notices of Opposition dated Dec. 3, 2018 corresponding to European Application No. 14815687.0-1102.

Opposition as filed dated Nov. 21, 2018 corresponding to European Application No. 14815687.0-1102.

* cited by examiner

METHOD FOR PROVIDING A PRETREATED FILLER COMPOSITION AND ITS USE IN PAPER AND BOARD MANUFACTURING

This is a National Phase Application filed under 35 U.S.C. 371 as a national stage of PCT/EP2014/078225, filed Dec. 17, 2014, an application claiming the benefit of Swedish Application No. 1351588-7, filed Dec. 30, 2013, the content of each of which is hereby incorporated by reference in its entirety.

TECHNICAL FIELD

The present invention is to be used within the pulp and paper industry, and relates to a method for providing a pretreated filler composition and its use in paper and board manufacturing.

BACKGROUND

The paper industry is constantly looking at new possibilites to increase the filler content and consequently reduce the fibre content in paper products due to the savings that can be made. The cost of filler is considerably lower than the price of fibres. In addition to cost reductions, an increased amount of fillers may also improve the printability and optical properties of the final paper product. However, it is to be noted that using an increased amount of filler may influence negatively on the products. A decrease of the mechanical properties of the paper product is a drawback. Thus, challenges that the industry are facing involve e.g. being able to utilize more filler in terms of both end product quality and machine runnability. The loss of strength as the filler disrupts the fibre-fibre bonding network of a sheet by reducing the number of fibres and preventing effective contact of the fibrils is a challenge to take on. A loss of strength is not desirable as for printing operations it may cause delamination.

AS can be concluded there is a need for increasing the binding between fibres and fillers to improve the strength of filled paper.

WO2013/107933 discloses a method for producing paper etc. A stock of fibres is combined with a pretreated filler dispersion comprising mineral filler and cationic pre-treatment agent.

WO2010/125247 discloses a method for preparing aqueous furnish to be used in paper or paper board. The furnish is prepared by addition of filler to a fibre suspension, wherein filler and/or fibres are treated with cationic electrolyte and nanofibrillated cellulose (NFC). The treatment of the filler with cationic polyelectrolyte and NFC may be carried out by mixing the filler with the cationic polyelectrolyte and NFC before adding them to the fibre suspension.

Even though different solutions to the problems disclosed above have been presented over the years, there is still a demand for new and improved ways that make it possible to use high contents of filler but without a significant decrease of the strength or other unwanted effects of the final paper product.

SUMMARY

The present invention relates to providing a method may be used to prepare paper related products with a high filler load and sufficiently good mechanical properties. By using a specific method of combining the components of the present invention a synergistic effect is obtained disclosing increased flocculating properties.

One object of the present invention is to provide a method for providing a pretreated filler composition for use in paper and board manufacturing comprising the steps of:

a) providing a filler comprising precipitated calcium carbonate, said filler being in the form of a slurry comprising no additives;
b) providing at least one polymer selected from polyvinylamine or polyacrylic amide, said polymer having a charge density of an absolute value of at most 4 meq/g determined at pH 7;
c) combining said at least one polymer of step b) with the filler of step a);
d) providing a slurry of nanofibrillar cellulose;
e) combining said nanofibrillar cellulose slurry with the formed combination of step c) and forming a pretreated filler composition comprising aggregates.

According to one embodiment the polyacrylamide may be cationic polyacrylamide or anionic polyacrylamide, preferably cationic polyacrylamide.

According to one embodiment the polymer has a molecular weight above 2 000 000 g/mol, preferably 2 000 000-20 000 000 g/mol, preferably 5 000 000-18 000 000, preferably 5 500 000-15 000 000 g/mol, more preferably 6 000 000-10 000 000 g/mol.

According to one embodiment the polymer has a charge density of an absolute value of about 0.05-2 meq/g, determined at pH 7.

According to one embodiment the polymer is chosen is polyvinylamine or cationic polyacrylamide and has a charge density of 0.1-1.35 meq/g, more preferably 0.2-0.7 meq/g, determined at pH 7.

According to one embodiment the polymer is anionic polyacrylamide and have a charge density of an absolute value of 0.1 to 1.8 meq/g, more preferably 0.2 to 1.6 meq/g, determined at pH 7.

According to one embodiment the mentioned at least one polymer is present in an amount of about 20-800 g per ton total amount of filler, preferably 50-300 g per ton filler, most preferably 100-200 g per ton filler.

According to one embodiment the nanofibrillated cellulose is present in an amount of about 1-20% of the dry weight of the total amount of filler.

According to one embodiment the aggregates of the pretreated filler composition have an aggregate size distribution defined as mean chord length value which is at least 5% higher than an original chord length value of only filler particles including the precipitated calcium carbonate, preferably the mean chord length value is 10-200%, preferably 15-100%, preferably about 20-80% higher than an original chord length value of only filler particles including the precipitated calcium carbonate, wherein mean chord length has been measured by Focused Beam Reflectance Measurement.

According to one embodiment the aggregates of the pretreated filler composition have an aggregate size distribution defined as mean chord length value which is at least 100% higher than an original chord length value of only filler particles including the precipitated calcium carbonate, preferably the mean chord length value is 110-300%, preferably 110-200% higher than an original chord length value of only filler particles including the precipitated calcium carbonate, wherein mean chord length has been measured by Focused Beam Reflectance Measurement.

According to one embodiment the formed aggregates have an aggregate floc stability, being the ratio of measured chord lengths after and before stirring of over 1000 rpm after flocculation, of at least 60%, preferably at least 65%.

According to one embodiment the content of precipitated calcium carbonate is at least 70% by weight, preferably at least 80% by weight, of the pretreated filler composition.

According to one embodiment the filler consists solely of precipitated calcium carbonate.

Another object of the present invention is to provide a pretreated filler composition prepared by above mentioned method.

Another object of the present invention is to provide a stock including a pretreated filler composition prepared by above mentioned method.

Another object of the present invention is to provide a paper or paper board manufactured using the pretreated filler composition prepared by the above mentioned method.

According to one embodiment the ash retention of a paper or paper board is at least 25%, preferably at least 30%, more preferably at least 40%, most preferably about 40-80%.

Another object of the present invention is to provide a method for producing paper or paper board comprising the steps of providing a pretreated filler composition prepared by above mentioned method and combining said pretreated filler composition with a stock of fibres.

According to one embodiment the pretreated filler composition is added into a thin stock before wet forming.

Another object of the present invention is to use a method for providing a pretreated filler composition for producing super calendered (SC) paper, lightweight coated (LWC) paper, newsprint paper, fine paper, folding boxboard, white top linerboard or white lined chipboard.

DETAILED DESCRIPTION

The present invention relates to in an effective manner make it possible to increase the filler content in paper, board or the like, in order to reduce papermaking costs while maintaining the strength properties and/or optical properties of the produced paper or board.

It has been surprisingly found that by combining the ingoing components in a certain manner, the pretreated filler composition comprising aggregates show aggregates with an increased size. The increase in size of the aggregates or flocs due to this method was an unexpected result which brought along interesting advantages. The formed flocs or aggregates in the formed composition to be added to a stock of fibres show a mean chord length value which increases e.g. at least with 5 percent or 100 percent from the original mean chord length value, for effective use in the processes of the pulp and paper industry.

The present method involves the steps of initially providing a filler comprising precipitated calcium carbonate, said filler being in the form of a slurry comprising no additives, and providing at least one polymer selected from polyvinylamine or polyacrylic amide; secondly combining said at least one polymer with the filler so that a surface treated filler is obtained; thirdly providing a slurry of nanofibrillar cellulose; and fourthly combining said nanofibrillar cellulose slurry with the formed combination mixture of filler and polymer and forming a pretreated filler composition comprising aggregates. It is important that the filler and polymer are combined and preferably mixed before any nanofibrillar cellulose is added. Upon addition of the nanofibrillar cellulose the total mixture is preferably mixed.

It is to be noted that the filler used according to the present invention is a filler in slurry form, which comprises precipitated calcium carbonate (PCC). The filler does not contain any type of additives, like stabilising agents etc. It is simply a combination of filler and water. As an alternative embodiment, other filler materials than precipitated calcium carbonate which may be used in paper manufacturing may be provided and introduced before any combination and mixing with a polymer. If present, said other filler materials are preferably present in minor amounts. Preferably the filler consists only of the precipitated calcium carbonate and water, wherein PCC are the sole filler particles. Examples of additional filers are ground calcium carbonate (GCC), clay, titanium dioxide, synthetic silicate, aluminium trihydrate, barium sulphate, magnesium oxide, kaolin, talcum or gypsum, or mixtures thereof.

The filler comprising precipitated calcium carbonate, i.e. the initial filler material provided for use in the present invention, preferably have a mean particle size (D50) of about 0.5-5 μm, preferably about 0.6-3 μm, most preferably about 0.7-2.5 μm. These particle sizes are of the filler particles before it is added to the present process, thus before agglomeration with polymer and NFC.

The method also includes addition of at least one polymer selected from polyvinylamine (PVAM) or polyacrylic amide (PAM). If polyacrylamide is used it may be cationic polyacrylamide (CPAM) or anionic polyacrylamide (APAM). Among the two preferably cationic polyacrylamide is used.

The polymer acts on the filler and a surface treated filler is obtained, i.e. the filler particles are surface treated with polymer.

Cationic polyacrylic amide may be produced by copolymerising acrylamide with a cationic monomer or methacrylamide with a cationic monomer. In a similar manner anionic polyacrylic amide may be produced by copolymerising acrylamide with an anionic monomer or methacrylamide with an anionic monomer.

The polymer may have a molecular weight above 2 000 000 g/mol, e.g. 2 000 000-20 000 000 g/mol, 5 000 000-18 000 000, 5 500 000-15 000 000 g/mol, or 6 000 000-10 000 000 g/mol.

In this application the value "average molecular weight" is used to describe the magnitude of the polymer chain length. Average molecular weight values are calculated from intrinsic viscosity results measured in a known manner in 1N NaCl at 25° C. The capillary selected is appropriate for the viscosity value to be measured, and in the measurements of this application an Ubbelohde capillary viscometer with constant K=0.005228 was used. The average molecular weight is then calculated from intrinsic viscosity result in a known manner using Mark-Houwink equation $[D]=K\cdot M^{a}$, where [D] is intrinsic viscosity, M molecular weight (g/mol), and K and are parameters given in Polymer Handbook, Fourth Edition, Volume 2, Editors: J. Brandrup, E. H. Immergut and E. A. Grulke, John Wiley & Sons, Inc., USA, 1999. In the case Ubbehold-MW was less than 1000 000, a GPH HPCL-SEC analysis with PEO reference polymer calibration was used.

Further, the charge density of the polymer may be of an absolute value of at most 4 meq/g, preferably an absolute value of about 0.05-2 meq/g, determined at pH 7, and measured by titration with Mutec PCD instrument with PesNa. By absolute value is herein to be interpreted as a real number x being the non-negative value of x without regard to its sign. E.g. the absolute value of 1 is 1, and the absolute value of −1 is also 1.

If the polymer is chosen from polyvinylamine or cationic polyacrylamide, it may have a charge density of 0.1-1.35 meq/g, more preferably 0.2-0.7 meq/g, determined at pH 7.

If the polymer is chosen is chosen from anionic polyacrylamide and have a charge density of an absolute value of 0.1 to 1.8 meq/g, more preferably 0.2 to 1.6 meq/g, determined at pH 7. Due to the anionic nature of the polymer the charge density is negative. Thus the charge density here could also be written as (−0.1) to (−1.8) meq/g, more preferably (−0.2) to (−1.6) meq/g, determined at pH 7.

In one embodiment the above mentioned polymer may be chosen from polyvinylamine and cationic polyacrylamide and has a charge density of at most 4 meq/g, preferably about 0.05-2 meq/g, preferably 0.1-1.35 meq/g, more preferably 0.2-0.7 meq/g, determined at pH 7, and a molecular weight above 2 000 000 g/mol, preferably 2 000 000-15 000 000 g/mol, preferably 5 000 000-10 000 000 g/mol, more preferably 6 000 000-8 000 000 g/mol.

In another embodiment the above mentioned polymer may be anionic polyacrylamide and has a charge density of an absolute value of at most 2 meq/g, preferably an absolute value of about 0.05 to 2 meq/g, preferably an absolute value of 0.1 to 1.8 meq/g, more preferably an absolute value of 0.2 to 1.6 meq/g, determined at pH 7, and a molecular weight above 2 000 000 g/mol, preferably 2 000 000-15 000 000 g/mol, preferably 5 000 000-10 000 000 g/mol, more preferably 6 000 000-8 000 000 g/mol.

In the case of the present method including more than one polymer, any second or following polymer is added to the first polymer or simultaneously with the first polymer to the filler composition or directly after the first polymer to the filler composition but before any further additions are made. If more than one polymer is used, they are preferably combined into one mixture of polymers, i.e. one single liquid solution comprising at least one of the polymers selected from the specified above.

The at least one polymer may be added to the filler particles in amount of about 20-800 g per ton total amount of filler (comprising the precipitated calcium carbonate), preferably 50-300 g per ton total amount of filler, most preferably 100-200 g per ton total amount of filler. In case two or more different fillers are used, the total amount filler comprises the precipitated calcium carbonate and any consecutive filler.

Nanofibrillar cellulose (NFC) may also be called nanocellulose, nanofibrillated cellulose, cellulose nanofiber, nano-scale fibrillated cellulose, microfibrillar cellulose, cellulose nanofibrils (CNF) or microfibrillated cellulose (MFC). The NFC fibrils are isolated from the wood-based fibers and the width and length of the NFC fibers vary depending on the specific manufacturing process. A typical width of NFC is from about 3 to about 300 nm, such as from about 3 to about 100 nm, from about 10 to about 300 nm, or from about 10 to about 100 nm; and a typical length is from about 100 nm to about 100 μm, such as from about 100 nm to about 50 μm, from about 200 nm to about 40 μm, from about 400 nm to about 30 μm, from about 500 nm to about 20 μm, or from about 500 nm to about 10 μm.

The fineness of the NFC used may be defined by the viscosity and transmittance.

The nanofibrillar cellulose is present in an amount of about 1-20% of the dry weight of the filler particles, e.g. 1.5-10% of the dry weight of the filler particles.

Preferably mixing is performed during the preparation of the pretreated filler composition. When the filler compound and the polymer(s) are combined, they are preferably mixed thoroughly before admixing the nanofibrillar cellulose. A well mixed pretreated filler composition is desirable for optimal performance.

The floc size distribution of the mineral filler is changed with the process according to the present method so that the mean chord length value increases at least 5% from the original mean chord length value. According to one embodiment the increase is typically about 10-200%, preferably about 15-100%, preferably about 20-80% from the original mean chord length value. According to another embodiment mean chord length value increases at least 100% from the original mean chord length value, typically about 110-300%, preferably about 110-200% higher from the original mean chord length value.

The original mean chord length value is the value measured for only the filler particles used, before any addition of polymer or nanofibrillar cellulose, and the mean chord length value includes said further addition of polymer or nanofibrillar cellulose. In this application the term "mean chord length" describes particle size which has been measured by using Focused Beam Reflectance Measurement (FBRM). The FBRM system uses a rotating laser optics design that can determine particle chord lengths by detecting reflected light from the particle. A laser beam is projected through a sapphire window and then the focused rotating laser beam contacts the particle, light is reflected and propagated back through the probe sapphire window. The particle continues to reflect light until the rotating focused beam reaches the opposite edge of the particle. Particle size is measured in terms of a "chord length", which is defined as the distance between two edges of a particle. The chord length (CL) may be presented as the reflected laser signal time (Δt (seconds)) multiplied with the scan speed of laser beam ($v_b$ (meters per second)), i.e. $CL=\Delta t*v_b$. All the floc size values in this application have been measured by using Focused Beam Reflectance Measurement (FBRM), the measurement range of the device being 1-1000 μm. Used FBRM apparatus is Lasentec FBRM Model D600L by Laser Sensor Technology, Redmond, Wash., USA, Serial No. 1 106, and its detector is D600L-HC22-K, Serial No. 961. The detector is installed in a DJJ vessel, manufactured by Paper research Materials Inc. and the sample volume is 500 ml. Stirring was performed at a speed of 1000 rpm.

Further, according to the present method, the formed aggregates show an aggregate floc stability of at least 60%, e.g. at least 65%, at least 70%, at least 75%, at least 80%, at least 85% or at least 90%. The wording floc stability is the ratio of measured chord lengths after and before high shear stirring of the flocculating matter. The flocculation influences the behavior of the matter and high shear forces are obtained upon stirring. Stirring above 1000 rpm after flocculation is considered to give a high shear stirring, preferably stirring of at least 1200 rpm, such as at least 1400 rpm or at least 1500 rpm. The floc stability may be disclosed as the ratio of measured chord lengths after a high shear stirring over 1000 rpm and before a high shear stirring over 1000 rpm, after flocculation. It is to be noted that all components needs to be added before the initial "before" value of the measured chord length can be obtained, i.e. filler, polymer and NFC needs to be incorporated for the "before" value to be comparable with the "after" value and to be used in the calculation of floc stability. After the addition of the above mentioned components the flocculation is obtained.

The use of a combination of the nanofibrillar cellulose, polymer and filler in accordance with the present method results in a manner which exhibits a synergistic effect of the combination in terms of an increased floc size, when compared to prior art.

Further there is provided a method for producing paper or paper board comprising the steps of providing a pretreated filler composition as disclosed above and combining said filler aggregate composition with a stock of fibres.

The present invention also relates to a process for the preparation of paper comprising adding a polymer to pulp stock before sheet formation to increase at least one paper property selected from retention, drainage rate, or paper dry strength. Paper and board may be produced using a pretreated filler composition prepared according to the above mentioned process.

In the pulp and paper industry, the pretreated filler composition produced according to the present method may be added to a stock. The stock being a furnish comprising chemical pulp or mechanical pulp or a combination thereof, not including recycled fibres. In this manner one may obtain paper or paper board using the pretreated filler composition prepared by the present method. The ash retention in paper or paper board produced accordingly is at least 25%, preferably at least 30%, more preferably at least 40%, most preferably about 40-80%. Ash retention is the weight of ash in 100 ml thin stock minus the weight of ash in 100 ml whitewater, which are divided by the weight of ash in 100 ml thin stock, and multiplied with 100(%). The ash retention may be measured using instruments and a high ash retention value points toward the final paper product being able to hold a high ash content (filler content).

The pretreated filler composition produced according to the present method may be used for production of paper and board and may in such a case be added into a thin stock before wet forming. The pretreated filler composition may be added at a time of less than 20 seconds before the wet forming. The pretreated filler composition produced according to the present method may be added after addition of a dosed starch and before addition of a retention polymer.

The present method may be used for producing super calendered (SC) paper, ultralight weight coated (ULWC) paper, light weight coated (LWC) paper, medium weight coated (MWC) paper, heavy weight coated (HWC) paper, machine finished coated (MFC) paper, uncoated woodfree (UWF) paper, woodfree coated (WFC) paper, lightweight coated (LWCO) printing paper, SC offset (SCO) printing paper, machine finished specialties (MFS), multilayer coated paper, inkjet paper, copy paper, newsprint paper, folding boxboard, white top linerboard or white lined chipboard. The invention is preferably used for producing super calendered (SC) paper, lightweight coated (LWC) paper, newsprint paper, fine paper, folding boxboard, white top linerboard or white lined chipboard.

EXAMPLES

1. General Principle of Conducting Focused Beam Reflectance Measurement (FBRM) Tests:

The test stock used was composed of fillers from a paper mill and diluting water (tap water). The filler was treated in the form of slurry with the desired solids content. The pretreatment polymer and NFC to be examined was added to the filler in the form of diluted aqueous slurry in 1% concentration. Filler pretreatment tests were conducted with a Focused Beam Reflectance Measurement (FBRM) apparatus. Used FBRM apparatus was Lasentec FBRM Model D600L by Laser Sensor Technology, Redmond, Wash., USA, Serial No. 1106, and its detector was D600L-HC22-K, Serial No. 961. The FBRM instrument is a flocculation analyzer that uses a highly focused laser beam and backscattered geometry as a principle of operation. From the collected data the FBRM instrument yields chord size distribution, mean of the chord size values and the number of particles detected. The measurement range of the device is adjusted to 1-1000 μm.

2. Type of Chemicals

The tests used the following step-wise procedure:

1. At moment 0 s and at stirring rate of 1000 rpm a filler sample diluted to 1% consistency (500 ml) was poured into a dynamic drainage jar DDJ (by Paper Research Materials Inc.).
2. At moment 15 s pretreatment polymer was dosed into the filler slurry.
3. At moment 25 s stirring rate 1000→1500 rpm.
4. At moment 30 s NFC was dosed into the filler slurry.
5. At moment 30 s stirring rate 1500→1000 rpm.
6. At moment 45 s mean particle size (D50)=mean chord length was measured
7. At moment 50 s stirring rate 1000→1500 rpm.
8. At moment 60 s stirring rate 1500→1000 rpm.
9. At moment 69 s mean particle size (D50)=mean chord length was measured.

It is to be noted that stirring at 50 S-60 S is considered to be stirring at high shear. Floc stability is the ratio of measured chord lengths after and before high shear. The high shear is a result of the stirring of the flocs that are obtained in the process. In this specific example the floc stability may be calculated as a percentage as follows (100*chord length at 69 s/chord length at 45 s).

The NFC used in these tests is referred to as sample A, diluted to 1% consistency. Dosage of NFC was 10% of dry filler composition. Polymer dosage was g/ton (g/t) of dry filler composition. The polymers used in these tests are presented below.

Polymer 1 is a CPAM with 6.4 Mg/mol and 0.5 meq/g (at pH 7).

Polymer 2 is a CPAM with 6 Mg/mol and 1.3 meq/g (at pH 7).

Polymer 3 is a CPAM with 800 000 g/mol and 1.3 meq/g (at pH 7).

Polymer 4 is a cationic potato starch, degree of substitution (DS) 0.035.

Polymer 5 is a APAM with 6 Mg/mol and −1.3 meq/g (at pH 7).

Polymer 6 is a PVAM with 4 Mg/mol and 4.3 meq/g (at pH 7).

Polymer 7 is a PVAM with 300 000 g/mol and 5.8 meq/g (at pH 7).

Polymer 8 is a PVAM with 4 Mg/mol and 0.6 meq/g (at pH 7).

TABLE 1

| Test | Polymer 1 | Polymer 2 | Polymer 3 | Polymer 4 | Polymer 5 | Polymer 6 | Polymer 7 | Polymer 8 | Mean chord length at 45 s, μm | Mean chord length at 69 s, μm | size increase after shear, % | floc stability, % |
|---|---|---|---|---|---|---|---|---|---|---|---|---|
| 0 | | | | | | | | | 4.0 | 4.0 | | |
| 1 | 0 | | | | | | | | 4.0 | 4.0 | 0 | 0 |
| 2 | 100 | | | | | | | | 7.9 | 6.8 | 71 | 86 |

TABLE 1-continued

| Test | Polymer 1 | Polymer 2 | Polymer 3 | Polymer 4 | Polymer 5 | Polymer 6 | Polymer 7 | Polymer 8 | Mean chord length at 45 s, μm | Mean chord length at 69 s, μm | size increase after shear, % | floc stability, % |
|---|---|---|---|---|---|---|---|---|---|---|---|---|
| 3 | 200 | | | | | | | | 10.0 | 7.9 | 100 | 79 |
| 4 | 400 | | | | | | | | 11.7 | 10.0 | 151 | 86 |
| 5 | 800 | | | | | | | | 13.6 | 10.8 | 171 | 79 |
| 6 | | 100 | | | | | | | 12.6 | 8.6 | 115 | 68 |
| 7 | | 400 | | | | | | | 21.5 | 15.8 | 298 | 74 |
| 10 | | | | 600 | | | | | 4.0 | 4.0 | 0 | 100 |
| 11 | | | | 1200 | | | | | 4.3 | 4.0 | 0 | 93 |
| 12 | | | | 3200 | | | | | 5.0 | 4.6 | 17 | 93 |
| 13 | | | | | 100 | | | | 10.0 | 7.4 | 85 | 74 |
| 14 | | | | | 400 | | | | 21.5 | 13.6 | 241 | 63 |
| 15 | | | 100 | | | | | | 4.0 | 4.0 | 0 | 100 |
| 16 | | | 400 | | | | | | 4.0 | 4.0 | 0 | 100 |
| 17 | | | | | | 100 | | | 9.3 | 7.4 | 85 | 79 |
| 18 | | | | | | 200 | | | 11.7 | 8.6 | 115 | 74 |
| 19 | | | | | | 400 | | | 15.8 | 11.7 | 193 | 74 |
| 20 | | | | | | | 100 | | 5.0 | 4.6 | 17 | 93 |
| 21 | | | | | | | 200 | | 6.3 | 5.0 | 26 | 79 |
| 22 | | | | | | | 400 | | 7.9 | 6.8 | 71 | 86 |
| 23 | | | | | | | | 100 | 7.9 | 6.3 | 59 | 79 |
| 24 | | | | | | | | 200 | 9.3 | 6.8 | 71 | 74 |
| 25 | | | | | | | | 400 | 10.0 | 7.4 | 85 | 74 |

Included is a reference test (test 0) which includes no polymer and no NFC, only filler. In the other tests 1-25, NFC is present.

From the table it can be seen that:

NFC alone don't agglomerate at all (see the comparison between test 0 and 1),

Low molecular weight materials are not as efficient, see polymer 3 and polymer 7, Starch (polymer 4) agglomerates only with high dosages, Polymer 2 and 5 aggregates effectively and the floc stability is ok, Polymer 1 is showing interesting and promising results. Polymers 6 and 8, are also disclosing very promising results.

3. NFC Quality

Three NFC with different fineness was tested. Fineness was determined trough measurements of viscosity and transmittance using following procedures.

The shear viscosities of dilute fibrillated cellulose samples were measured by a Brookfield rheometer model RVDV-III Ultra using vane type spindles. The measurements were performed at 1.5% consistency. Samples were first mixed with a propel mixer for 10 minutes at 300 rpm and then with ultrasound mixing at 50% amplitude for two minutes. The temperature of the samples were adjusted to 20±1° C. The shear viscosity was measured at 300 measuring points at 10 rpm, 20 rpm as well as at 100 measuring points at 50 rpm and 100 rpm. The relative viscosities were measured twice for each sample. Light mixing was performed between the measurements. The torque during the measurements was kept between 10 and 100%.

Transmittance was measured by Perkin Elmer Lambda 900 UV-VIS spectrophotometer at 0.1% sample consistency. The samples were well dispersed into Milli-Q water before testing with propel mixer for 10 minutes at 300 rpm and then with ultrasound mixing at 50% amplitude for one minute. Samples were analysed immediately after dispersing so that no flocculation or sedimentation would take place. The transmittance was measured at wavelengths between 200 and 800 nm.

TABLE 2

| Sample | Viscosity, mPas-s, 10 rpm, 1.5% conc. | Transmittance, %, 800 nm, 0.1% conc. |
|---|---|---|
| A | 22 502 | 60.2 |
| B | 400 | 0.5 |
| C | 3 654 | 26.2 |

Transmittance: The transparency increases while particle size decreases.

Viscosity: The viscosity increases while particle size decreases

Sample B is a more coarse material than A and C, which is shown by the low viscosity and transmittance values. Sample A is the most fine material of the tested samples.

The same step-wise test procedure was performed as above. NFC samples were diluted to 1% consistency. Dosage of NFC was 10% of filler composition. Polymer dosage was g/t of dry filler composition.

TABLE 3

| | Polymer 1, g/t | NFC | Mean chord length at 45 s, μm | Mean chord length at 69 s, μm | size increase after shear, % | floc stability, % |
|---|---|---|---|---|---|---|
| 0 | | | 4.0 | 4.0 | | |
| 1 | 0 | A | 4.0 | 4.0 | 0 | 100 |
| 2 | 100 | A | 7.9 | 6.8 | 71 | 86 |
| 3 | 200 | A | 10.0 | 7.9 | 100 | 79 |
| 4 | 400 | A | 11.7 | 10.0 | 151 | 86 |
| 5 | 800 | A | 13.6 | 10.8 | 171 | 79 |
| 6 | 100 | C | 9.3 | 7.4 | 85 | 79 |
| 7 | 200 | C | 10.8 | 8.6 | 115 | 79 |
| 8 | 400 | C | 13.6 | 10.0 | 151 | 74 |
| 9 | 100 | B | 14.7 | 10.0 | 151 | 68 |
| 10 | 200 | B | 20.0 | 12.6 | 216 | 63 |

Polymer dosage was g/ton (g/t) of dry filler compound.

From the table 3 it can be seen that:

at lower polymer dosages coarse NFC, sample B, is more effective in size increase.

4. Dosing Order

Example 6 illustrates how dosing order affects the floc size. The test was conducted as a FBRM test. The test composition consisted of a precipitated calcium carbonate, PCC slurry. The pretreatment polymer was the cationic polyacrylamide Polymer 1. The NFC was a commercial cellulose, Daicel KY-100 G 2.5%.

The tests used the following step-wise procedure: (experiment for dosing order)

1. At moment 0 s and at stirring rate of 1000 rpm a filler sample diluted to 1 (:)/0 consistency (500 ml) was poured into a dynamic drainage jar DDJ (by Paper Research Materials Inc.)
2. At moment 15 s pretreatment polymer was dosed into the filler slurry (embodiment PCC+CPAM+NFC)
3. At moment 30 s NFC was dosed into the filler slurry.
4. At moment 35 s pretreatment polymer was dosed into the filler slurry (embodiment PCC+NFC+CPAM)
5. At moment 50 s stirring rate 1000→1800 rpm
6. At moment 60 s stirring rate 1800→1500 rpm
7. At moment 111 s mean particle size (D50)=mean chord length was measured.

It is to be noted that stirring at 50 S-60 S is considered to be stirring at high shear.

The results of mean chord length before and after pretreatment (after 111 s) are presented in table 4.

Floc size=mean chord length after shear

Test consistency g/l

PCC=10 g/l=1%

Dosages are g/ton filler as active (dry)

TABLE 4

| | time, s | | | | |
|---|---|---|---|---|---|
| | 15 | 30 | 35 | 111 | 111 |
| | Chemicals | | | | |
| | Polymer 1 g/t | NFC, Daicel, g/t | Polymer 1, g/t | Floc size MCL, μm | Size increase after shear; % |
| test 1 | | 0 | | 5.4 | 0 |
| test 2 | | 50000 | | 5.5 | 2 |
| test 3 | | 100000 | | 5.7 | 6 |
| test 4 | | 200000 | | 6.0 | 11 |
| test 5 | 125 | 50000 | | 7.9 | 47 |
| test 6 | 125 | 100000 | | 7.4 | 36 |
| test 7 | 125 | 200000 | | 7.6 | 41 |
| test 8 | | 50000 | 125 | 6.4 | 19 |
| test 9 | | 100000 | 125 | 6.3 | 17 |
| test 10 | | 200000 | 125 | 6.4 | 18 |

5. Effect of Dosing Order and Polymer Dosage

The tests used the following step-wise procedure:

1. At moment 0 s and at stirring rate of 1000 rpm a filler sample diluted to 1% consistency (500 ml) was poured into a dynamic drainage jar DDJ (by Paper Research Materials Inc.)
2. At moment 15 s pretreatment polymer or NFC was dosed into the filler
3. At moment 30 s NFC or pretreatment polymer was dosed into the filler slurry
4. At moment 45 s mean particle size (D50) was measured (before shear)
5. At moment 50 s stirring rate 1000→1500 rpm
6. At moment 60 s stirring rate 1500→1000 rpm
7. At moment 65 s mean particle size (D50) was measured (after shear)

It is to be noted that stirring at 50 S-60 S is considered to be stirring at high shear.

TABLE 5

| test | dosing order | Polymer 1, g/t | Mean chord length at 45 s, μm | Mean chord length at 69 s, μm | size increase after shear, % | floc stability, % |
|---|---|---|---|---|---|---|
| 0 | | | 4.0 | 4.0 | | |
| 1 | Polymer 1, NFC A | 100 | 7.9 | 6.8 | 71 | 86 |
| 2 | Polymer 1, NFC A | 200 | 10.0 | 7.9 | 100 | 79 |
| 3 | Polymer 1, NFC A | 400 | 11.7 | 10.0 | 151 | 86 |
| 4 | NFC A, polymer 1 | 100 | 5.8 | 5.0 | 26 | 86 |
| 5 | NFC A, polymer 1 | 400 | 7.4 | 6.3 | 59 | 86 |
| 6 | same time | 100 | 4.3 | 4.0 | 0 | 93 |
| 7 | same time | 200 | 4.3 | 4.3 | 8 | 100 |

From the tables 4 and 5 it can be seen that:

Dosing order has strong influence on agglomeration behavior,

If polymer is added at the same time with NFC (or together) there is no or very little agglomeration at all, Best effect is achieved when dosing order is polymer before NFC, i.e. PCC filler, followed by polymer, followed by NFC.

6. Paper Strength

Commercial bleached pressure ground wood pulp (PGW) was used as furnish mix 83% and commercial bleached Enorein lightly refined chemical spruce/pine pulp 17%. The filler was undispersed scalenohedral precipitated calcium carbonate (PCC). According to the manufacturer, the average particle size of this PCC was 1.9 μm. In the pretreated filler composition a CPAM (polymer 1) was used and the dosage was 125 g/t of dry filler and the NFC was Daicel KY-100G 2.5%. A two component retention system including Ashland cPAM PC435, 200 g/t and anionic organic microparticle SP700, 500 g/t, was used.

The pretreated filler composition was made using offline Lasentec equipment (polymer and NFC addition timing 15 s before and 5 s in the after situation). The pretreated filler composition was mixed into pulpmix. After 5-10 s PC435 was added and after 20 s from CPAM microparticles SP700 was added.

Laboratory handsheets were made with a standard sheet moulder (Lorentzen & Wettre AB, Sweden according to standard SCAN-C 26:76) with a 100 mesh wire. The sheets were wet-pressed by 3.5 bar at first 5 minutes and after that 2 minutes. The grammage of sheets were adjusted to be 52 g/m$^2$. Pressed sheets were dried in laboratory upper side against gloss plate in following conditions: Temperature 23° C. and relative humidity of 50%±2%). Sheets were tightened against fabric frame and dried at least 16 hours. The samples were conditioned at temperature 23±1° C. and RH=50±2% at least 4 hours before analyzing them.

The sheet properties were analyzed according to SCAN standards.

The basis weight according to SCAN-P 6:75. The tensile strength and the strain at break according to SCAN-P 38:80 and calculation of elasticity of modulus according to SCAN-P 67:93 with Lloyd measurement device. The ash content of sheets was measured according to the SCAN-P 5:63 standard using calculations the coefficient 1.78 for calcium carbonate. The ash retention was thereafter determined based on the measured ash content.

TABLE 6

| | Mean chord length before high shear, μm | Mean chord length after high shear, μm | Ash retention [%] | Tensile index |
|---|---|---|---|---|
| PCC | 5.4 | 5.4 | 63 | 10.7 |
| PCC 45% + 2.5% Daicel | 5.6 | 5.5 | 69.5 | 11.9 |
| PCC 45% + CPAM + 2.5% Daicel | 9.6 | 7.9 | 77.8 | 13.1 |
| PCC 45% + 2.5% Daicel + CPAM | 14.7 | 6.4 | 75.7 | 12.5 |

As can be seen, the combination of filler, polymer and NFC in the pretreatement composition results in an improved ash retention, i.e. increased ash content, and tensile index of the sheeted products. It is also noticed that the specific combination order, filler, polymer and NFC show considerably better results than the other addition order.

The invention claimed is:

1. A method for providing a pretreated filler composition for use in paper and paper board manufacturing, comprising the steps of:

a) providing a filler comprising precipitated calcium carbonate, said filler being in the form of a slurry comprising no additives;

b) providing at least one polymer selected from the group consisting of polyvinylamine and polyacrylic amide, said at least one polymer having a charge density of an absolute value of at most 4 meq/g determined at pH 7 and having a molecular weight above 2,000,000 g/mol;

c) combining said at least one polymer of step b) with the filler of step a), wherein the at least one polymer is combined with the filler at a concentration of between 100 g and 400 g of the at least one polymer per one ton of the filler;

d) providing a slurry of nanofibrillar cellulose;

e) combining said slurry of nanofibrillar cellulose with the formed combination of step c), resulting in formation of a pretreated filler composition, which pretreated filler composition comprises aggregates formed by said nanofibrillar cellulose, said at least one polymer, and said filler, wherein said aggregates of the pretreated filler composition have an aggregate size distribution defined as mean chord length value which is at least 100% higher than an original chord length value of only filler particles including the precipitated calcium carbonate, wherein mean chord length is measured by Focused Beam Reflectance Measurement.

2. The method according to claim 1, wherein said polyacrylamide may be cationic polyacrylamide or anionic polyacrylamide.

3. The method according to claim 1, wherein said polymer has a charge density of 0.05-2 meq/g, determined at pH 7.

4. The method according to claim 1, wherein said polymer is polyvinylamine or cationic polyacrylamide and has a charge density of 0.1-1.35 meq/g, determined at pH 7.

5. The method according to claim 4, wherein said at least one polymer is polyvinylamine or cationic polyacrylamide and has a charge density of 0.2-0.7 meq/g, determined at pH 7.

6. The method according to claim 1, wherein said polymer is anionic polyacrylamide and have a charge density of an absolute value of 0.1 to 1.8 meq/g, determined at pH 7.

7. The method according to claim 6, wherein said at least one polymer is anionic polyacrylamide and have a charge density of an absolute value of 0.2 to 1.6 meq/g determined at pH 7.

8. The method according to claim 1, wherein the formed aggregates have an aggregate floc stability, being the ratio of measured chord lengths after and before stirring of over 1000 rpm after flocculation, of at least 60%.

9. The method according to claim 8, wherein the formed aggregates have an aggregate floc stability, being the ratio of measured chord lengths after and before stirring of over 1000 rpm after flocculation, of at least 65%.

10. The method according to claim 1, wherein said at least one polymer has a molecular weight of at most 20,000,000 g/mol.

11. The method according to claim 1, wherein said at least one polymer has a molecular weight of 5,000,000-18,000,000 g/mol.

12. The method according to claim 1, wherein the aggregate size distribution is 110-300% higher than an original chord length value of only filler particles including the precipitated calcium carbonate, wherein mean chord length is measured by Focused Beam Reflectance Measurement.

13. The method according to claim 1, wherein the aggregate size distribution is 110-200% higher than an original chord length value of only filler particles including the precipitated calcium carbonate, wherein mean chord length is measured by Focused Beam Reflectance Measurement.

14. The method according to claim 1, wherein the at least one polymer is combined with the filler at a concentration of between 100 g and 400 g of the at least one polymer per one ton of the filler.

15. The method according to claim 1, wherein the at least one polymer has a molecular weight between 5 Mg/mol and 18 Mg/mol.

16. A pretreated filler composition prepared by the method according to claim 1.

17. A stock including a pretreated filler composition according to claim 16.

18. A paper or paper board manufactured using the pretreated filler composition prepared by the method according to claim 1.

19. The paper or paper board according to claim 18, wherein the paper or paper board is selected from the group consisting of super calendered (SC) paper, lightweight coated (LWC) paper, newsprint paper, fine paper, folding boxboard, white top linerboard, and white lined chipboard.

20. The paper or paper board according to claim 18, wherein ash retention is at least 25%.

21. The paper or paper board according to claim 20, wherein ash retention is at least 30%.

22. The paper or paper board according to claim 20, wherein ash retention is at least 40%.

23. The paper or paper board according to claim 20, wherein ash retention is 40-80%.

24. A method for producing paper or paper board, comprising the steps of:

providing a pretreated filler composition according to claim 1;

combining said pretreated filler composition with a stock of fibres of a paper or board manufacturing process; and providing sheets from the stock of fibres containing the pretreated filler composition to provide said paper or paper board.

25. The method according to claim 24, wherein said pretreated filler composition is added into a thin stock before wet forming.

* * * * *